US005333168A

United States Patent [19]

Fernandes et al.

[11] Patent Number: 5,333,168

[45] Date of Patent: Jul. 26, 1994

[54] TIME-BASED ATTENUATION COMPENSATION

[75] Inventors: Mark Fernandes, Layton; Chris R. Soderstrom; Donley L. Bush, both of West Valley City; DeeAnn Dorman, Salt Lake City, all of Utah

[73] Assignee: OEC Medical Systems, Inc., Salt Lake City, Utah

[21] Appl. No.: 11,255

[22] Filed: Jan. 29, 1993

[51] Int. Cl.[5] ..... H05G 1/44

[52] U.S. Cl. ..... 378/108; 378/97; 378/117

[58] Field of Search ..... 378/91, 96, 97, 108, 378/114, 117

[56] References Cited

U.S. PATENT DOCUMENTS

| | | | |
|---|---|---|---|
| 3,971,945 | 7/1976 | Franke | 378/108 |
| 4,748,649 | 5/1988 | Griesmer et al. | 378/97 |
| 5,008,914 | 4/1991 | Moore | 378/108 |
| 5,218,625 | 6/1993 | Heidsieck | 378/108 X |

*Primary Examiner*—David P. Porta

*Attorney, Agent, or Firm*—Blakely, Sokoloff, Taylor and Zafman

[57] ABSTRACT

A method and apparatus employed in an X-ray apparatus for compensating for attenuation caused by a subject to perform an improved X-ray exposure. A table is created comprising entries accessible via power and attenuation values. Each of the entries includes a first value T representing a time for radiation in the system to reach a base ion count, and a second value C representing an offset ion count from the base ion count. A first set of entries in the table are referenced using a first power setting, and a first base ion count is determined based upon the first power setting, and a maximum radiation exposure is determined for the first power setting and a subject's mass. Then, an X-ray emitter is activated until a current ion count from a radiation sampling means has exceeded the base ion count or total radiation emitted has exceeded the maximum radiation allowed for the given mass of a subject. If the current radiation has exceeded the maximum radiation, then the X-ray emitter is deactivated and the process terminates. If the current ion count from the radiation sampling means has exceeded the base ion count, then it is determined whether the base ion count has been offset. If so, then the X-ray emitter is deactivated and the process terminates. If the base ion count has not been offset, then a matching entry is determined from the first set of entries which has the first value T less than or equal to the current exposure. Then, the second value C of the matching entry is added to the base ion count, and the process is repeated until the above conditions are matched.

8 Claims, 6 Drawing Sheets

400

600

TIME-BASED ATTENUATION COMPENSATION

BACKGROUND OF THE INVENTION

1. Field of the Invention

The present invention relates to x-ray devices. Specifically, the present invention relates to an apparatus for providing automatic film exposure control to control the optical density in x-ray film radiographs to compensate for attenuation caused by a subject under examination.

2. Background of Related Art

It is a desired capability for modern x-ray systems to provide some sort of attenuation compensation. Such systems should have a capability to compensate for attenuation caused by different subjects to optimize the exposure for those particular subjects. For example, large-mass objects may require large amounts of x-ray radiation in order to perform an x-ray exposure which have sufficient optical density for the quality desired. Smaller massed objects, in contrast, may not require as much x-ray radiation in order to create the same optical density in the resulting image. Attenuation compensation is a desired capability in x-ray systems since overexposure or underexposure of an x-ray image essentially ruins the image for any useful diagnostic purpose. Additional exposures may thus have to be performed, exposing the subject to more radiation than would otherwise have been required.

Some prior art systems have utilized a technique for attenuation compensation which allows the operator to select, using a selector dial or a series of pushbuttons, a particular attenuation level. In other words, the exposure may be optimized for a large attenuator (e.g., a full-grown adult) or a small attenuator (e.g., a child). Operators of such prior art x-ray apparatus thus make subjective judgments on the attenuation based upon their estimation of the patient thickness. It is hoped that the operator accurately selects the proper attenuation to optimize the optical density of the exposure. These systems suffer from the disadvantage that the operator is forced to make a subjective judgment about the amount of attenuation caused by the subject. These devices also suffer from a cluttered control panel of the x-ray apparatus providing for a less user-friendly design. It is thus desired to control the variance and optical density of exposures within very specific parameters to optimize picture quality. Attenuation compensation is also increasingly a requirement in specifications for modern x-ray systems. Consistency of optical density is desired and may be optimized by the use of an exposure control system which regulates the amount of radiation reaching the film, as passed through an attenuator (e.g., a subject under examination). Such a system would provide many advantages over the prior art apparatus for attenuation control in an x-ray imaging system.

SUMMARY AND OBJECTS OF THE INVENTION

One of the objects of the present invention is to provide an apparatus which eliminates the need for subjective evaluations by x-ray operators to evaluate the amount of attenuation of subjects.

Another of the objects of the present invention is to provide a means for controlling an x-ray apparatus which requires little or no operator intervention.

Another of the objects of the present invention is to provide an improved means for attenuation control in x-ray exposures which utilizes ion chambers and samples taken from the ion chambers at given intervals.

Another of the objects of the present invention is to provide an improved x-ray apparatus which provides consistent optical density across films exposures during x-ray exposures.

These and other objects of the present invention are provided for by a method and apparatus employed in an X-ray apparatus for compensating for attenuation caused by a subject to perform an improved X-ray exposure. The apparatus comprises an X-ray emitter, means for activating and deactivating said X-ray emitter, a means for sampling radiation from said emitter after the radiation has passed through and imaged a subject, and a control means coupled to the activation/-deactivation means and the sampling means. The method performed by the control means includes creating a table comprising entries accessible via power and attenuation values. Each of the entries includes a first value T representing a time for radiation in the system to reach a base ion count, and a second value C representing an offset ion count from the base ion count. The method references a first set of entries in the table using a first power setting, determines a first base ion count based upon the first power setting, and determines a maximum radiation exposure for the first power setting and mass of the patient. Then, the X-ray emitter is activated until a current ion count from the radiation sampling means has exceeded the base ion count or total radiation emitted has exceeded the maximum radiation allowed for the given mass of a subject. If the current radiation has exceeded the maximum radiation, then the X-ray emitter is deactivated and the process terminates. If the current ion count from the radiation sampling means has exceeded the base ion count, then it is determined whether the base ion count has been offset. If so, then the X-ray emitter is deactivated and the process terminates. If the base ion count has not been offset, then a matching entry is determined from the first set of entries which has the first value T less than or equal to the current exposure. Then, the second value C of the matching entry is added to the base ion count, and the process is repeated until the above conditions are matched. In a preferred embodiment, the sampling means comprise ion chambers mounted in the region of the film cassette.

BRIEF DESCRIPTION OF THE DRAWINGS

The present invention is illustrated by way of example and not limitation in the figures of the accompanying in which like references indicate like elements and in which.

DETAILED DESCRIPTION

A method and apparatus for improved exposures from x-ray apparatus is described. In the Following description, specific hardware devices, methods steps, and other specifics are set forth in order to provide a thorough understanding of the present invention. However, it will be apparent to one skilled in the art that the present invention may be practiced without these specific details. In other instances. well-known systems and methods are shown in diagrammatic, block, or Flow diagram form in order to not unnecessarily obscure the present invention.

X-ray Imaging System

Figure 1:
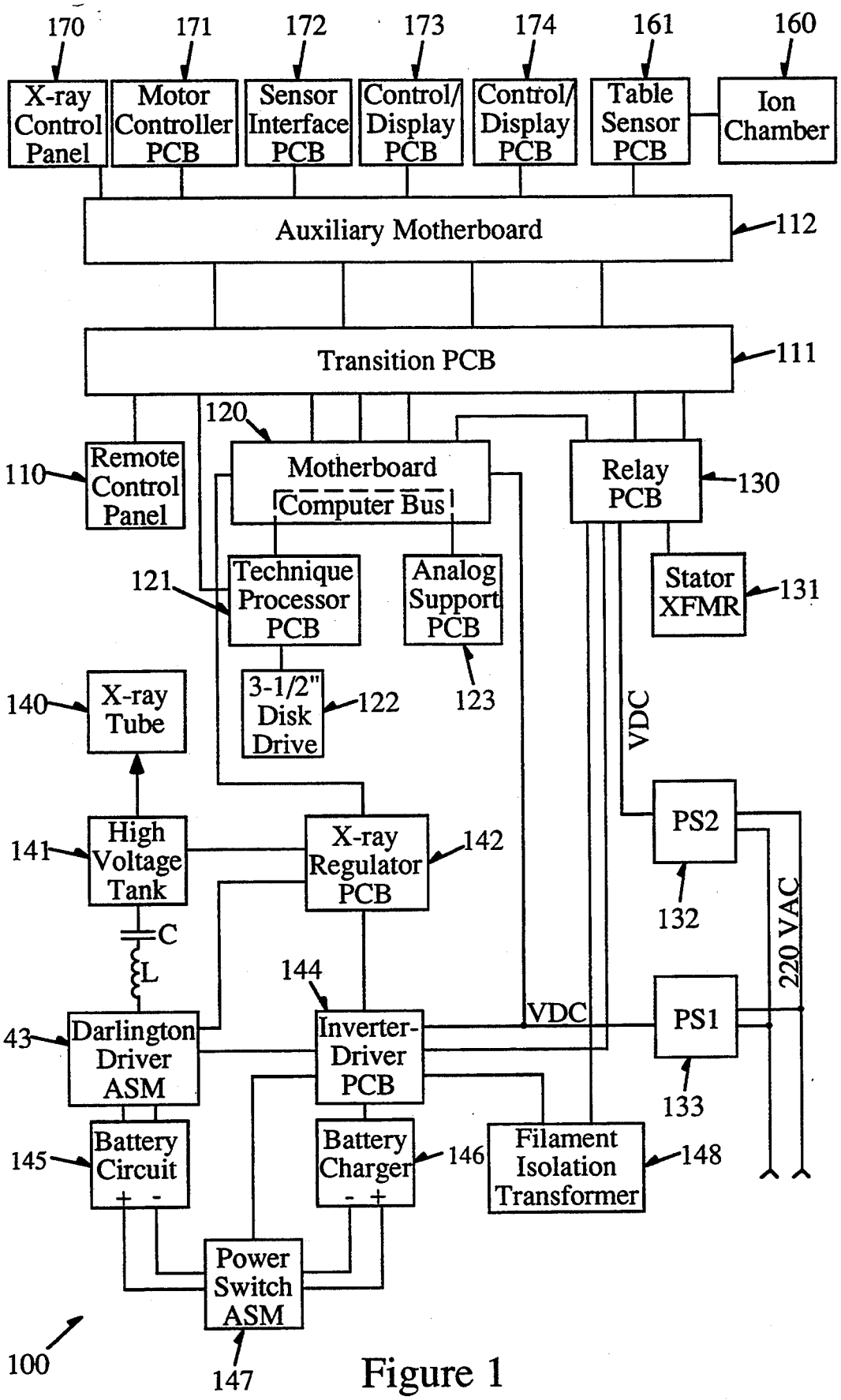
FIG. 1 shows a system block diagram of a system upon which the apparatus and methods of the present invention are practiced.

The preferred embodiment of the present invention is an x-ray system which is used for imaging subject (i.e., human patients) for providing film exposures of the human body. This apparatus is illustrated by the block diagram shown in FIG. 1 as system 100. Note that relevant blocks are shown in FIG. 1 for the purposes of simplicity, and some x-ray systems have additional functional blocks or apparatus which have not been illustrated here, to provide additional capabilities of the imaging system. In the diagram illustrated in FIG. 1, system 100 comprises an x-ray tube 140 along with its associated power supplies and electronics. This includes high-voltage tank 141 which generates the high voltage to supply the necessary power requirements of x-ray tube 140, Darlington driver ASM (assembly) unit 143 which is powered by battery circuit 145, and Inverter-Driver printed circuit board (PCB) 144. Power from the battery is regulated by power switch ASM circuit 147, and the battery is maintained in a charged state by battery charger 146. The circuit further comprises a filament isolation transformer 148 for generating required filament current.

Power to the system is supplied through power supplies 132 and 133. Power to the motherboard circuitry 120 and associated electronics is supplied via relay printed circuit board 130 and to transition printed circuit board 111 for connection to other associated electronics in the system. Operator control is provided through remote control panel 110 which allows the adjustment of various parameters within the system. Motherboard 120 provides coupling with various printed circuit boards (PCB's) for control and measurement of various parameters in the system. Main control and processing of these parameters are provided by a technique processor CPU which is resident on technique processor PCB 121. The technique processor CPU includes an 80188 microprocessor available from Intel Corporation of Santa Clara, Calif. Technique processor PCB comprises programmable selects for memory and peripheral devices such as those resident in various PCB's of the system, a programmable interrupt controller, two DMA channels, and three programmable timers. The technique processor PCB 121 also comprises various memories in the form of 256 k (kilobytes) of dynamic random access memory (DRAM) for storage of the operating system and main technique processor software, a 16 k electrically programmable read-only memory (EPROM) for storage of the boot program to load the operating system from disk drive 122 and further to provide debugging capabilities, and a 2 k electrically erasable programmable read-only memory (EEPROM) which is used for storage of system-specific data. The system also contains a 512-byte dual port RAM used for communications between the analog support PCB and the technique processor PCB.

Technique processor 121 comprises the software required during run time to implement the methods and utilize the control capabilities to implement automatic attenuation compensation. Technique processor PCB 121 receives the necessary executable code during run time in order to implement these methods. Such code is generated in 80188 assembly code and assembled into executable code for loading during run time.

Technique processor 121, via transition PCB 111 and through motherboard 120, is coupled to various PCB's in the system in order implement the attenuation compensation. For example, technique processor PCB 121 is coupled via transition PCB 111 and auxiliary motherboard 112 to a table sensor PCB 161. This interface card is also coupled to a series of ion chambers 160 which are mounted in the film transport mechanism of the imaging apparatus. These ion chambers are provided to sample x-ray radiation received at the film. The rate of change of a voltage from the ion chamber read in determines the amount of attenuation that has been caused by the subject in the path of the beam. Table sensor 161 allows technique processor 121 to select any one or any combination of three ion chambers (discussed below) to be sampled to determine the amount of radiation reaching the film and thus how much the beam has been attenuated. Thus, the operator may select a particular ion chamber(s) for specific anatomy which is desired to be imaged. Technique processor 121 is also coupled to analog support PCB 123 which is also coupled to ion chambers 160 in the preferred embodiment for sampling voltages from the ion chambers 160 to determine the amount of radiation reaching the film. Analog support PCB 123 digitizes the voltage and provides as an output a full word of binary data representing the amount of the radiation received in the selected ion chamber.

Through the use of analog support PCB 123 and table sensor PCB 161, x-ray attenuation may be determined at the location of the film tray. The accurate determination of radiation attenuated by the attenuation mass (e.g., the patient) allows technique processor 121 to adjust the exposure time for the attenuation mass in order to optimize optical density of the film. Exposure control is provided by technique processor 121 via x-ray regulator PCB 142. This control will be discussed in more detail below.

Ion Chambers Used in the Preferred Embodiment

Figure 2:
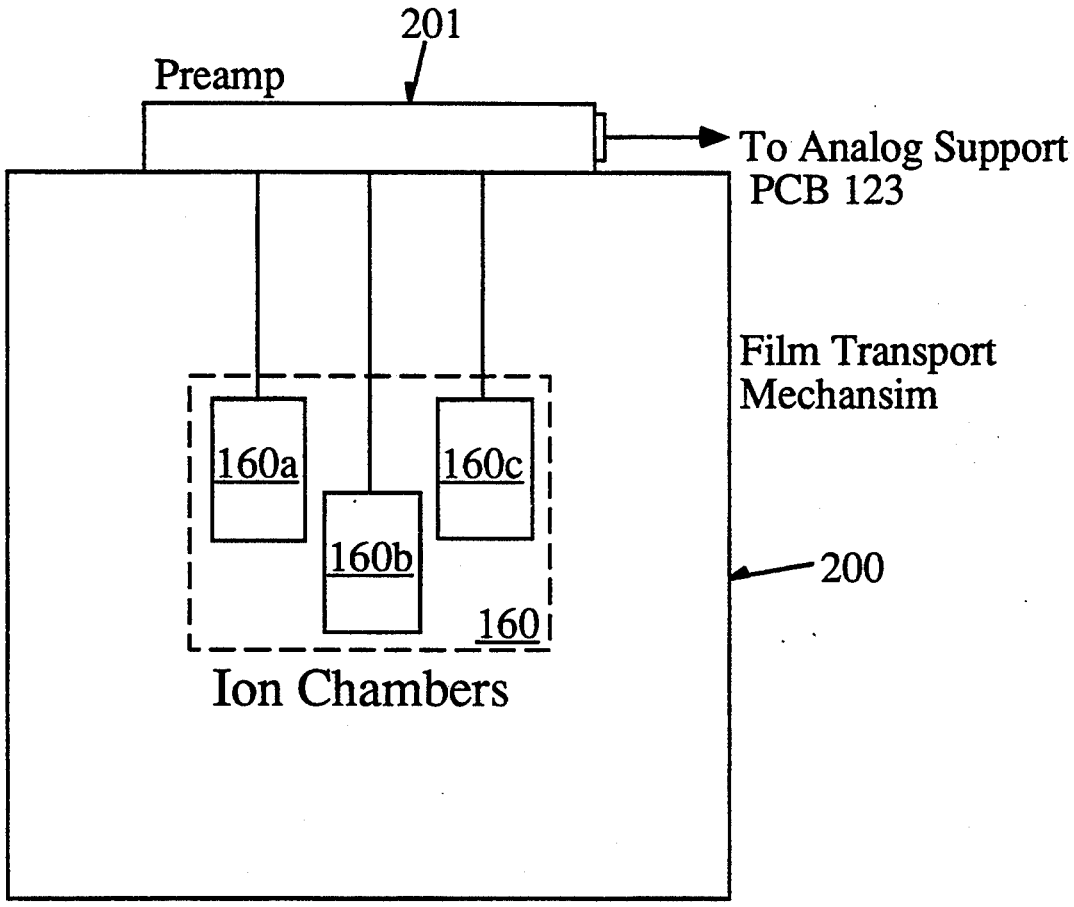
FIG. 2 shows the ion chamber and related apparatus attached to the film transport mechanism.

FIG. 2 illustrates in more detail the ion chambers used in the preferred embodiment. FIG. 2 illustrates film transport mechanism 200 which is part of the normal x-ray apparatus used for exposures. 200 shows the layout of the various ion chambers from the doctor's perspective as standing at the foot of the x-ray apparatus table. Ion chambers 160 reside in the central region of film transport mechanism 200 to sample radiation doses at various points in the image. Using these three ion chambers, illustrated as 160*a*, 160*b*, and 160*c*, the radiation received at various areas in the image may be sampled. A consistent optical density across films, as a function of the voltages of ion chambers 160, may thus be obtained. Each of ion chambers 160 are coupled to a preamplifier device 201 which is further coupled to the analog support PCB 123 shown in FIGS. 1 and 3. Ion chambers 160 are those of the type in general usage and may be available from companies such as Advanced Instrument Technology Development, Inc. of Melrose Park, Ill. These chambers 160 provide as output to preamplifier 201 a voltage indicating the amount of exposure each ion chamber has received since a last reset. The time to reach a certain voltage may be used as an indication of the amount of attenuation caused by the attenuation mass based upon the set power of the x-ray beam. The exposure time may be thus increased or decreased by technique processor 121 to control the optical density of the film. Voltage generated by ion chambers 160 is increased by preamplifier 201 to a level which may be detected and digitized by analog support PCB 123. Preamplifier 201 is one of the 60917 preamplifiers available Advanced Instrument of Melrose Park, Ill.

Figure 3:
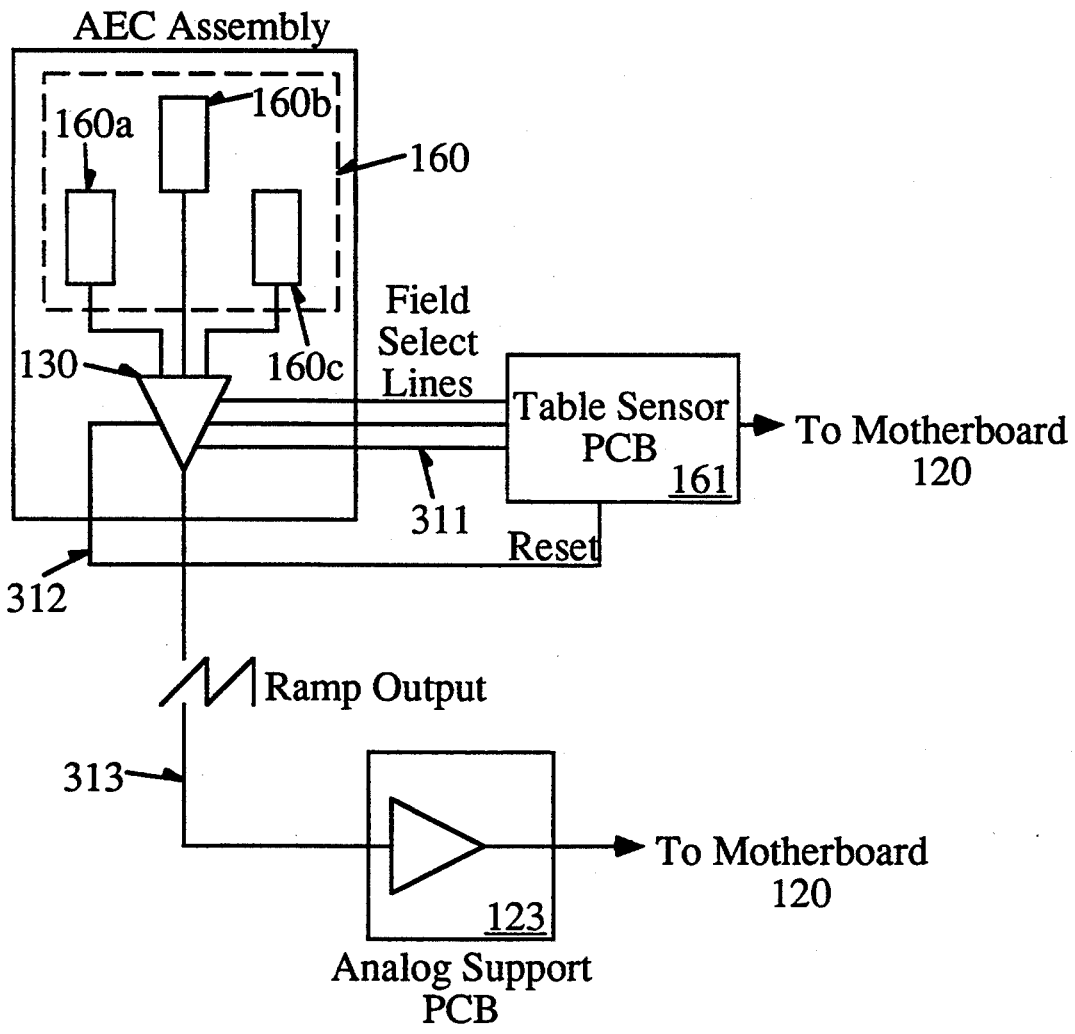
FIG. 3 shows the selection lines and automatic exposure assembly and its coupling to the analog support PCB of the present preferred embodiment.

FIG. 3 shows the selection mechanism used in the preferred embodiment for selecting from which of the ion chambers the voltage will be sampled. In addition to preamplifier 201 shown in FIG. 2, automatic exposure control assembly 200 comprises a selection device 310 which allows one or any combination of the three ion chambers 160*a*, 160*b*, or 160*c* to be selected using field select lines 310 from table sensor PCB 161. Each of the field select lines 311, each referred to as IONSEL1, IONSEL2, and IONSEL3, are used for selecting each of the ion chambers 160*a*–160*c*, respectively or collectively, to receive a voltage from. If more than one ion chamber has been selected by the operator, then each ion chamber is selected sequentially and sampled by analog support PCB 130, and the resulting signal(s) are averaged at technique processor PCB 121. If the expected count value in any of the ion chambers exceeds a peak voltage able to be represented by AEC preamplifier 201, then the voltage ramp is reset by a signal transmitted over signal line 312 entitled IONRST, also generated from table sensor PCB 161. In this instance, the count number received from the ion chamber is added to the previous peak value of the previous voltage ramp and compared to the expected count (retrieved from a table, discussed below) to terminate the exposure. The ion chamber reset signal IONRST is also transmitted at the beginning of each x-ray exposure. Output front ion chambers 160 is provided over signal line 313 to analog support PCB 123. Then, the ramp voltage output from the ion chamber may be digitized by analog to digital (A/D) converters in analog support PCB 123 and transmitted as a binary word of data to technique processor 121 for computations and determination of whether the exposure should continue. The detailed operation of technique processor 121, for generation of attenuation tables and for use during exposure operations of system 100, will now be discussed.

Attenuation Lookup Table

The preferred embodiment utilizes a technique wherein automatic exposure control is provided for x-ray film shots by determining the amount of radiation reaching the film plate after attenuation caused by the subject. Then, the technique makes an evaluation based upon calibration x-ray exposures which are stored in memory to adjust the remaining time x-rays are emitted. In this manner, exposure time may be carefully controlled thus subjecting the subject to the minimum amount of x-ray radiation while optimizing the optical density of the film exposure for enhanced image quality. The table used by the preferred embodiment contains entries with times and ion count values in order to ascertain the proper duration of the x-ray exposure depending upon the attenuation of the x-ray beam caused by the subject at a given point in the exposure. This table is illustrated with reference to FIG. 5, and a procedure used for initializing the table is shown in FIG. 4.

The attenuation lookup table of the preferred embodiment is illustrated with reference to 500 of FIG. 5. In the preferred embodiment, the table is a two-dimensional array of elements which has as one dimension the exposure power supplied (in kilovolts or kV) and a second dimension which is the various levels of attenuation caused by the subject. In the preferred embodiment, tile table has 14 kV settings, as illustrated by axis 501, and four separate attenuation settings, as illustrated by axis 502. In the preferred embodiment, the power settings comprise two sets: six power settings for a large "spot" exposure; anti eight for a small "spot" exposure, for a total of 14 power settings. Therefore, the table has a total of 56 entries which comprise the attenuation lookup table used in the preferred embodiment. Each entry of each row, such as 511, 512, 513, or 514, comprises two separate fields: a first field 511*a* which is used for storing a time value T: and 511*b* which stores an offset C of a base ion count. Time value 511*a* is used as a reference for the amount of time that the ion chamber takes to reach a base ion count. The base ion count is calculated based upon calibration exposures performed on the apparatus and upon desired optical densities as set by either the operator or the manufacturer. The second field 511 *b* contains a value C which tile base ion count should be offset to perform an exposure having the desired optical density. Thus. using the first field in each entry (e.g., 511*a*), it can be determined how much the base ion count may be offset by the second value C stored in field 511*b*, depending upon the attenuation to the x-ray beam. Attenuation to the beam is determined based upon the time the exposure takes to reach the base ion count. In this manner, radiation to perform the film shot is minimized for the optical density desired. The initialization of table 500 is discussed with reference to process flow diagram 400 of FIG. 4.

Initialization of the Attenuation Lookup Table

Figure 4:
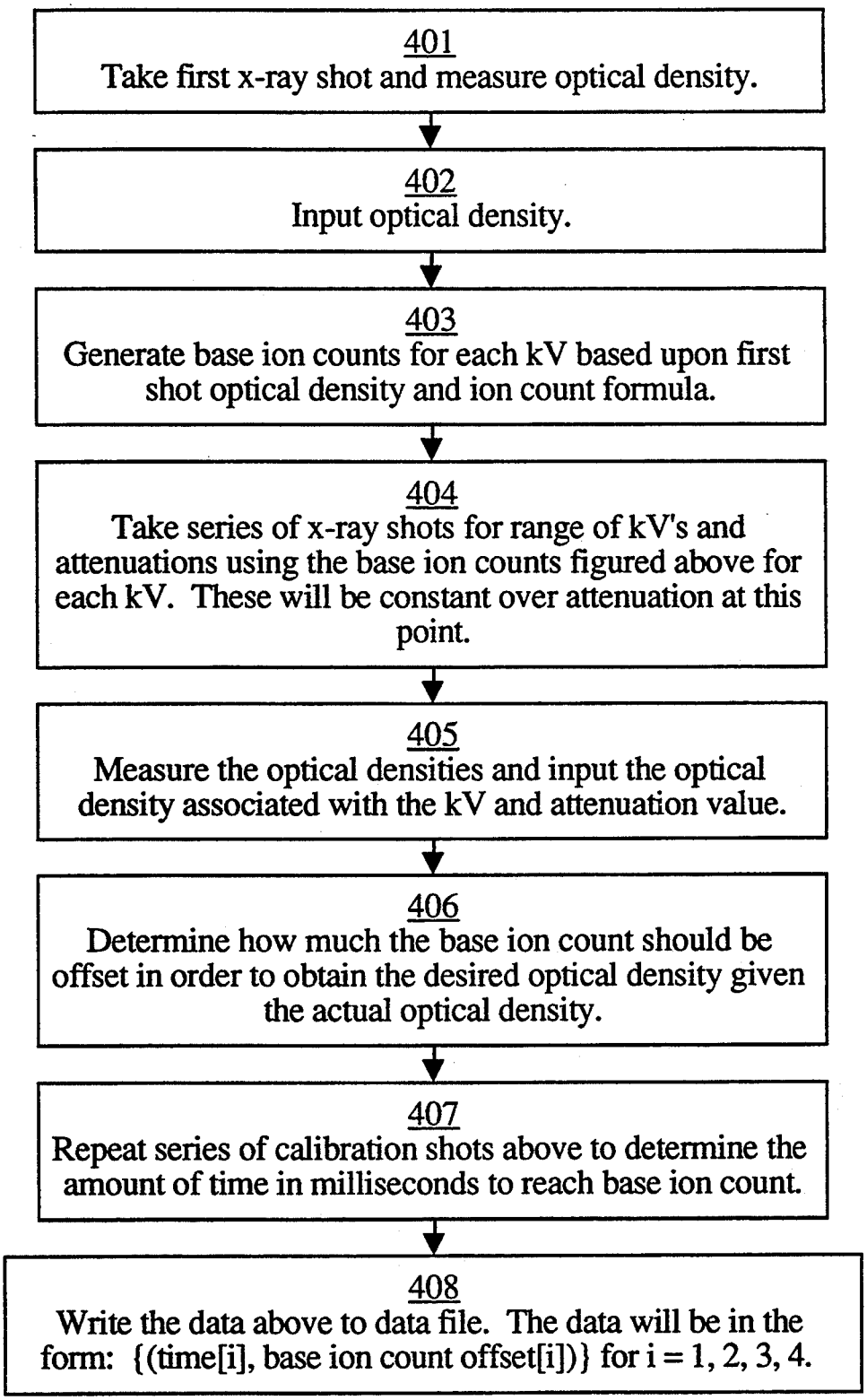
FIG. 4 shows a process flow diagram of a method for initializing the lookup table which is used for automatic exposure control in the preferred embodiment.
Figure 5:
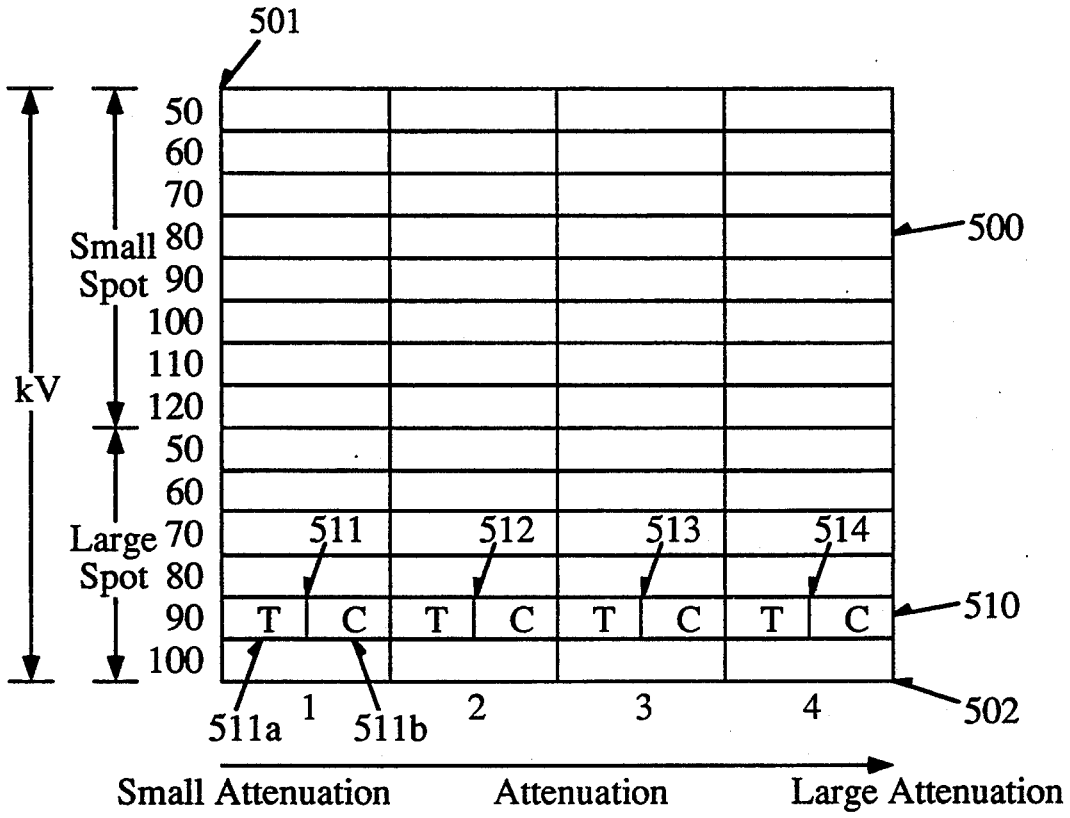
FIG. 5 shows a view of a lookup table used for automatic exposure control in the preferred embodiment.

FIG. 4 illustrates a procedure which is used for initializing the exposure lookup table and other stored values used in the preferred embodiment. Process 400 is typically performed by a manufacturer prior to shipping the unit. Process 400 starts at step 401 and take an initial x-ray calibration exposure which will be used to measure the optical density of the system with an average amount of attenuation in the x-ray path. For example, this may be a shot of the small "spot" beam at an 80 kV setting with an 8-inch thick block of Lucite attenuating material. This is performed at step 401, and the optical density of the resulting film it is measured manually using a densitometer at step 402. Then, at step 403, depending upon the initial calibration exposure performed at step 401, base ion counts for each power setting (in kV) for the measured optical density and desired optical density may be determined at step 403. The various base ion counts are calculated using the following formula:

$$\text{base ion count} = \frac{\text{1st guess about ion count} \cdot \text{ratio}}{1 - 0.020616 \cdot (kV \text{ of 1st calibration shot} - \text{actual } kV}$$

wherein, after the calibration shots, the ratio is equal to:

$$\frac{\text{desired optical density}}{\text{measured optical density of calibration shot}}$$

For initial settings, the ratio is 1. The "1st guess ion count" in the preferred embodiment is equal to either 115 or 100 for either the large or small spot sizes, respectively. Thus, for each power setting, there is a base ion count which is calculated and stored for use as a base value with each power setting in order to perform the exposure.

Then, at step 404, a series of calibration x-ray shots is taken for the various power settings and attenuations using the base ion counts calculated at step 403. For each power setting, various calibration attenuation masses are placed in the x-ray path to provide attenuation calibration values. In the preferred embodiment, four sets of attenuation masses are placed into the path of the x-ray beam to simulate each of the four different attenuation settings shown in the columns of table 500. Each of the attenuation masses used in the preferred embodiment comprise Lucite blocks of various thicknesses measuring 4 inches, 6 inches, 8 inches, and 10 inches, for the four different attenuation settings. In addition, all four attenuation masses are used for each power setting in the particular x-ray apparatus being used. As is illustrated in FIG. 5, this may comprise a range of power settings from 50 kV to 120 kV each incremented by 10. Interpolation between surrounding entries is used to fill in the remaining entries in the table. During exposure time for intermediate power settings not resident in the table, interpolation is also used to calculate the time T and base ion count offset C values. Using each of the optical densities determined, the power and attenuation values are generated at step 405.

At step 406, depending upon the calculated base ion count and the ion count measured by the calibration exposures, it is determined how much the base ion count should be offset (either by subtracting or adding to the base ion count) in order to obtain the desired optical density given the actual optical density measured during calibration.

At step 407, another series of calibration exposures is performed in order to determine the amount of time it takes the apparatus to reach the base ion count plus the offset C calculated above. In this manner, the time value T may be stored for each power and attenuation setting. For each of the entries in the table, the time value T is then associated with each entry, such as 511*a* shown in FIG. 5. At step 408, the table generation is complete, each entry having a time T and a base ion count offset C for each of the entries in attenuation lookup table 500 shown in FIG. 5. Thus, at step 408, all the calculated times and ion count offsets are stored into the table for different techniques. In the preferred embodiment, a small index (e.g., 1) for the attenuation setting indicates a low attenuation value, and a high index (e.g., 4) indicates a high attenuation value entry. Each of these base ion count and offset ions count values may be retrieved during exposure time in order to determine the proper ion count to achieve the optimum optical density of the film.

An Automatic X-ray Exposure Using the Attenuation Table

Once the apparatus has been calibrated using various attenuation masses and various power settings, as discussed with reference to FIG. 4 above, the unit is ready to perform exposures. Procedure 600 illustrates a process which is performed when an x-ray exposure is to be made. This routine is embodied in the procedures START_AEC_FILM_X-RAYS and ADC_WORK which are called upon the detection that the operator desires to perform an AEC (automatic exposure control) film exposure. This is illustrated in process flow diagram 600 of FIG. 6. At step 601 of process 600, the process reads table 500 with the time T and offset C pairs stored in nonvolatile memory for each calibration power into a table in volatile memory. At step 602, depending on the amount of power chosen in the kilovolt range, the corresponding time/offset pairs are retrieved from the table and used to generate the appropriate entries for various attenuation masses. If the power level chosen is for a voltage setting which was not one of the calibration voltages, then, using the two surrounding calibration power settings, the time T and offset ion count C values for the particular voltage setting desired are interpolated. For example, if the exposure was to be performed at a 76-kV setting and the calibration voltages were at 70 and 80 kV, respectively, then an intermediate entry, for time T and offset ion counts C are calculated using the two surrounding calibration entries. Also, the base ion count is computed in a similar manner to the base ion count for the generation of lookup table 500, as discussed above. Thus, at step 602, a complete set of four time/ion count offset pairs have been retrieved from the table.

Then, at step 603, it is determined whether the offset for the lowest attenuation is negative. If so, then the base ion count is adjusted, and each of the offset ion counts are recalculated adding the offset value to each of the ion count values. The least attenuated ion count will thus have an offset of zero. Then, at step 604, the base ion count and the time/offset pairs T/C are stored for use during the exposure. At step 605, an interrupt occurs to call the appropriate Bootprom procedures on the nonvolatile memory (e.g., the EPROM) for the performance of the x-ray with the automatic exposure control enabled.

Figure 6:
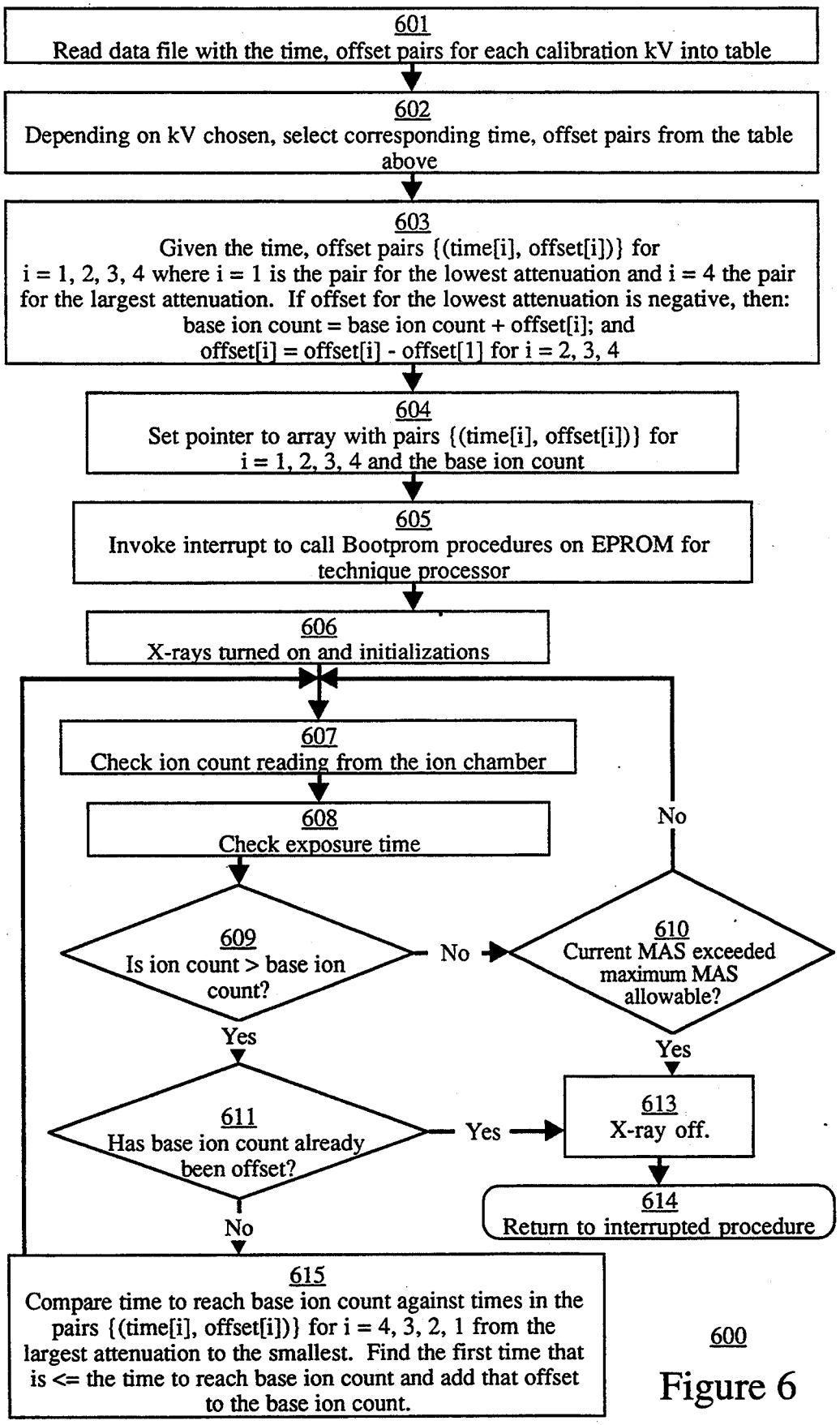
FIG. 6 shows a process flow diagram of a procedure taken during the time when exposure is performed.

Then, at steps 607 and 608 of FIG. 6, ion count reading and exposure time are monitored to determine whether they reach specified quantities. At step 609, it is determined whether the current ion count has exceed the base ion count. If not, then it is determined at step 610 whether the current MAS (milliamp-seconds) radiation limit has exceeded the maximum MAS allowable for the given power setting and the mass of the patient. Current MAS is calculated based upon the mass of the patient and the power setting of the apparatus set by an operator using well-known techniques. If the ion count has not exceeded the base ion count or the MAS has not exceeded the maximum MAS allowable, as determined at steps 609 and 610, then process 600 continues at steps 607–610 monitoring the ion count readings from the ion chamber(s) 160 and the overall exposure time.

If, however, at step 609, it is determined that the current ion count has exceeded the base ion count, then process 600 proceeds to step 611 which determines whether the base ion count has already been offset. If the base ion count has already been offset, then process 600 proceeds to step 613 which terminates the x-ray. Then, at step 614, a return is made to the interrupted procedure.

If, however, the base ion count has not already been offset, as determined at step 611, then process 600 proceeds to step 615. Step 615 will compare the current time to reach the base ion count against various times in the four attenuation pairs. It starts from the largest attenuation pair (e.g., that having the index i=4) to the smallest (having i=1) and finds the time that is less than or equal to the time it took to reach the base ion count. Then, the first entry with the time T that is less than or equal to the current exposure time to reach the base ion count is retrieved, and the offset C is added to the base ion count. X-ray exposure continues, and steps 607–610 continue in an iterative fashion until either the maximum MAS has been exceeded or the current ion count has exceeded the base ion count (including any offset) at steps 609 and 610. If the current MAS has exceeded the maximum MAS allowable, as determined at step 610, then process 600 proceeds to step 613 which terminates the x-ray. Then, at step 614, a return is made to the interrupted procedure.

Thus, using the foregoing methods and apparatus, automatic exposure control of an x-ray apparatus may be performed. Although there are other automatic exposure systems in present use, none to date have utilized the lookup table used in the preferred embodiment including exposure times T, base and offset (C) ion counts as is set forth in the present invention. Although specific details such as number of entries, power settings, and other specific details have been set forth for a thorough understanding of the present invention, the figures are to be not viewed as limiting and merely illustrated over the subject matter to which the present invention is directed.

Thus, an invention for attenuation compensation in an x-ray apparatus has been described. Although the present invention has been described particularly with reference to specific data structures, processes, etc., as illustrated in FIGS. 1–6, it may be appreciated by one skilled in the art that many departures and modifications may be made by one of ordinary skill in the art without departing from the general spirit and scope of the present invention.

What is claimed is:

1. In an X-ray apparatus comprising an X-ray emitter, means for activating and deactivating said X-ray emitter, a means for sampling radiation from said emitter after said radiation has passed through and imaged a subject, and a control means coupled to said activation/deactivation means and said sampling means, an automatic method performed by said control means for compensating for attenuation caused by said subject to perform an improved X-ray exposure comprising the following steps:

a. creating a table comprising entries accessible via power and attenuation values, each of said entries including a first value T representing a time for radiation in said system to reach a base ion count, and a second value C representing an offset ion count from said base ion count;

b. referencing a first set of entries in said table using a first power setting, determining a first base ion count based upon said first power setting, and determining a maximum radiation for said first power setting;

c. activating said X-ray emitter until a current ion count from said radiation sampling means has exceeded said base ion count or a current radiation has exceeded said maximum radiation;

d. if said current radiation has exceeded said maximum radiation, then deactivating said X-ray emitter and terminating;

e. if said current ion count from said radiation sampling means has exceeded said base ion count, then determining whether said base ion count has been offset, and if so, then deactivating said X-ray emitter and terminating; and f. if said base ion count has not been offset, then determining a matching entry of said first set of entries which has said first value T less than or equal to said current exposure, adding said second value C of said matching entry to said base ion count, and returning to step C.

2. 1 The method of claim 1 wherein said sampling means comprises an ion chamber.

3. The method of claim 1 wherein said step of referencing said first set of entries comprises determining whether a first set of entries exists for said first power setting, and if not, then creating said first set of entries by interpolation from two sets of entries for power settings immediately greater than and immediately less than said first power setting.

4. The method of claim 3 further comprising the step of resetting said means for sampling radiation prior to activating said X-ray emitter.

5. An improved X-ray apparatus comprising an X-ray emitter, means for activating and deactivating said X-ray emitter, a means for sampling radiation from said emitter after said radiation has passed through and imaged a subject, and a control means coupled to said activation/deactivation means and said sampling means, for compensating for attenuation caused by said subject to perform an improved X-ray exposure comprising:

a. means for creating a table comprising entries accessible via power and attenuation values, each of said entries including a first value T representing a time for radiation in said system to reach a base ion count, and a second value C representing an offset ion count from said base ion count;

b. means for referencing a first set of entries in said table using a first power setting, means for determining a first base ion count based upon said first power setting, and means for determining a maximum radiation for said first power setting;

c. means for activating said X-ray emitter until a current ion count from said radiation sampling means has exceeded said base ion count or a current radiation has exceeded said maximum radiation;

d. means for deactivating said X-ray emitter and terminating if said current radiation has exceeded said maximum radiation;

e. means for deactivating said X-ray emitter and terminating if said current ion count from said radiation sampling means has exceeded said base ion count, and said base ion count has been offset; and f. means for determining a matching entry of said first set of entries which has said first value T less than or equal to said current exposure if said base ion count has not been offset, means for adding said second value C of said matching entry to said base ion count, and means for sequentially reactivating elements c–f.

6. The apparatus of claim 5 wherein said sampling means comprises an ion chamber.

7. The apparatus of claim 5 wherein said means for referencing said first set of entries comprises means for creating said first set of entries by interpolation from two sets of entries for power settings immediately greater than and immediately less than said first power setting if a first set of entries does not exist for said first power setting.

8. The apparatus of claim 6 further comprising ion chamber resetting means operative prior to said activation of said means for activating said X-ray emitter.

* * * * *